US009157632B2

(12) United States Patent
Stiefel

(10) Patent No.: US 9,157,632 B2
(45) Date of Patent: Oct. 13, 2015

(54) WATER-COOLED SLIDING COMBUSTION GRATE HAVING A PARALLEL DRIVE

(75) Inventor: Martin Stiefel, Ottikon (CH)

(73) Assignee: DOIKOS INVESTMENTS LTD., St. Helier Jersey (GB)

( * ) Notice: Subject to any disclaimer, the term of this patent is extended or adjusted under 35 U.S.C. 154(b) by 98 days.

(21) Appl. No.: 13/812,395

(22) PCT Filed: Jul. 21, 2011

(86) PCT No.: PCT/CH2011/000169

§ 371 (c)(1),
(2), (4) Date: Jan. 25, 2013

(87) PCT Pub. No.: WO2012/012909

PCT Pub. Date: Feb. 2, 2012

(65) Prior Publication Data

US 2013/0118390 A1 May 16, 2013

(30) Foreign Application Priority Data

Jul. 30, 2010 (CH) ..... 1258/10
Apr. 14, 2011 (CH) ..... 661/11

(51) Int. Cl.

| | |
|---|---|
| ***F23H 3/02*** | (2006.01) |
| ***F23H 7/04*** | (2006.01) |
| ***F23H 11/20*** | (2006.01) |
| ***F23H 17/08*** | (2006.01) |
| ***F23H 11/06*** | (2006.01) |
| ***F23H 11/12*** | (2006.01) |
| ***F23H 7/08*** | (2006.01) |

(52) U.S. Cl.

CPC .. *F23H 3/02* (2013.01); *F23H 7/04* (2013.01); *F23H 7/08* (2013.01); *F23H 11/06* (2013.01); *F23H 11/12* (2013.01); *F23H 17/08* (2013.01); *F23H 11/20* (2013.01); *F23H 2900/03021* (2013.01)

(58) Field of Classification Search

CPC ..... F23H 7/00; F23H 7/06; F23H 7/08; F23H 2900/03021; F23H 11/20; F23H 3/02; F23H 3/04; F23H 17/08; F23K 2203/004; F23K 3/08

USPC ..... 126/174, 175; 110/281, 282, 283, 284, 110/291

See application file for complete search history.

(56) References Cited

U.S. PATENT DOCUMENTS 1,629,282 A * 5/1927 Lundgren ..... 110/291
4,018,168 A * 4/1977 Andreoli et al. ..... 110/268

(Continued)

FOREIGN PATENT DOCUMENTS

JP 03274310 A * 12/1991 ..... F23G 5/50

*Primary Examiner* — David J Laux

(74) *Attorney, Agent, or Firm* — CUSPA Technology Law Associates, P.A.; Yi Li

(57) ABSTRACT

The invention relates to a water-cooled sliding combustion grate, comprising a combination of movable grate plates (6) and stationary grate plates (5). The length of the grate plates (5, 6) passing over the grate track width is more than 6 meters. The movable grate plates (6) are driven by one parallel drive each, which comprises two separate drive units, which can each move a respective end area of a movable grate plate (6) back and forth, wherein the two drive units can be synchronized. To separate the primary air transversely over the grate track over a plurality of areas, at least one partition can extend along the grate track under the grate. Each partition is moved along with the lower faces of the grate plates (5, 6) at the upper edge of said partitions so that said partitions are fully connected everywhere to the lower faces of the grate plates.

16 Claims, 10 Drawing Sheets

(56) References Cited

Figure 1:
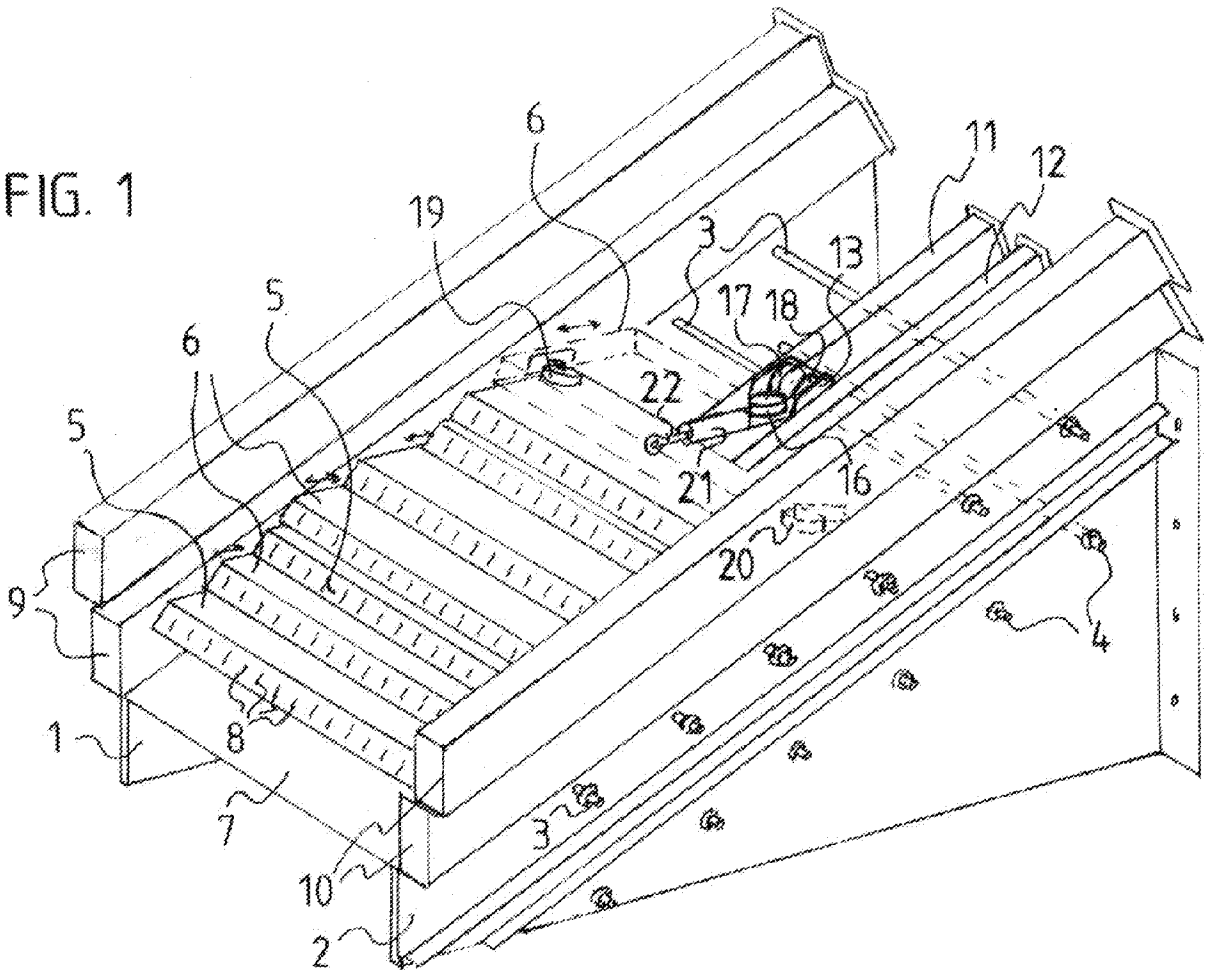
FIG. 1 PRIOR ART

U.S. PATENT DOCUMENTS 4,494,469 A * 1/1985 da Silva Pinto ..... 110/281
4,519,323 A * 5/1985 Takano et al. ..... 110/281
5,269,287 A * 12/1993 Krieger ..... 126/175
5,913,274 A * 6/1999 Kunzli et al. ..... 110/328
6,024,031 A * 2/2000 Stiefel ..... 110/281

* cited by examiner

WATER-COOLED SLIDING COMBUSTION GRATE HAVING A PARALLEL DRIVE

The invention pertains to a water-cooled siding combustion grate for refuse incineration plants which are especially suitable for burning of inhomogeneous refuse and waste with partially high heating values. Such sliding combustion grates have fixed and movable grate stages made of grate plates or made of a row of grate bars in which the grate plates are laid out on top of each other in a stairway formation. These grates can be installed in such a way that the combustion bed basically lies horizontally or else inclined, whereby slopes of 20 angular degrees or more are common. Grate plates are preferably made of steel sheets and they form board-shaped hollow bodies which extend over the complete width of the grate track. Water is channelled through these as a cooling medium. Every second grate plate is designed so as to be movable in the longitudinal direction and can therefore execute a sliding or feeding stroke. When it concerns the feed grate, the movable grate plates can push the incinerator charge with their front side to the next underlying grate plate. On the other hand, a reverse feed grate forms a virtually inverted, integrated, inclined staircase with overlapping steps. In the case of a reverse feed grate, the front sides of the movable grate plates carry the incinerator charge lying behind them back, after which this is again milled downwards in the direction of the slope of the grate. The movable grate plates, i.e. the respective grate plates located between two fixed grate plates, are moved to and from in the drop direction of their slope. This ensures that the refuse burning on the grate is constantly relocated with a high retention time of 45 to 120 minutes and is equally distributed on the grate.

European patent document, EP-0 621 449, refers to a water-cooled sliding combustion grate. This grate has grate plates which stretch over the complete width of the grate track and do not consist of multiple grate bars per grate stage. Like the stationary grate plates, the movable grate plates are fixed at the back to crossbars which collectively move forwards and backwards during operation and hence move the movable grate plates. European patent document, EP 0 874 195, shows a special design of such a grate with individual drives for every single movable grate stage. Here the movable grate plates roll on the steel rolls and are also laterally guided on the horizontal rolls along the lateral end planks. The drive is implemented with each hydraulic piston-cylinder unit per grate plate, which impinges on the grate plates from the rear, approximately at the centre and is located under the grate.

The previous water-cooled sliding combustion grates were assembled with widths of approx. 3 m to 6 m, which means that a sliding combustion grate is composed of grate plates which extend over this width and are also 3 to 6 meters long. Such a sliding combustion grate with laterally restricted planks is designated as a grate track. The drive occurs for each movable grate plate with the help of a centrally arranged, individual hydraulic cylinder-piston unit below the grate and behind movable grate plate, as described and illustrated in European Patent Document EP 0 874 195. The grate plates are laterally guided at the lateral planks by means of horizontal steel rolls. The planks laterally restrict such a combustion grate.

The following disadvantages could be observed with such an individual drive compared to a previously practised mode of operation where the movable grate plates were operated collectively by a central, proportionally large dimensioned cylinder-piston unit and were laterally guided at the side planks without rolling support and instead abrasively: Previously, tiny particles could get stuck laterally between the grate plate and the lateral end cover plate of the side planks during operation leading to a lateral tilting of the grate plate, which means that the grate plate was no more exactly parallel to the neighbouring stationary grate plates when seen from above. If it is moved in this condition, the plate impinges on the lateral end plates with a huge leverage that develops as a result. The necessary driving force becomes correspondingly greater. The wear caused by the huge friction force was considerable and minimised the lifetime of the complete grate. The individual drive of the single movable grate plates shown in the European paten document EP 0 874 195, enables an optimisation of the combustion process by means of a systematic local feed and a systematic local transportation of the incinerator charge. The laterally rolling bearing leads to a minimisation of the wear and a reduction of the necessary driving force.

Wider grate tracks are always desirable with increasing capacity requirements. However the drive with a central cylinder-piston unit reaches its threshold in case of longer grate plates or larger grate track widths, in spite of lateral rolling guidance or lateral bearing of the grate plates with the help of steel rolls at the lateral grate planks. In particular, the grate plates post a threat of tilting with a width of more than 6 meters. The traditional drive solution for the movable grate plates is moreover present underneath the grate in the middle of the grate plates and is accessible there only when the grate is not in operation. And even if it possible to realise a grate with a grate track width of, for example, 10 meters, it would result in the problem that the primary air that is supplied downwards may not be systematically used depending on the waste composition because such a wide combustion grate and a wide grate track cannot be permanently fed with a necessarily homogeneous distribution of similar combustible incinerator charge. It also happens that a specific amount of incinerator charge accumulates over the width of the grate or the grate track due to inhomogeneous refuse and this material burns significantly easier than any other accumulation on the same grate plate or on the same longitudinal section of the grate track. It would result in the primary air streaming highly unevenly and incorrectly from bottom to top through the combustion grate. Where the incinerator charge is easily combustible, there would be a significant excess of primary air because little flow resistance would be registered there and where the incinerator charge is poorly combustible, there would be a higher flow resistance and correspondingly less flow of primary air. The easily combustible incinerator charge would therefore burn rapidly and the poorly combustible incinerator charge lying nearby would burn poorly or not at all due to inadequate supply of primary air because the incinerator charge itself obstructs the primary air vents.

Conventional grates are already equipped with partitions for primary air supply in the longitudinal direction. There it concerns stationary partitions installed underneath the grate and particularly underneath the stationary grate plates. Thereby the combustion grate can be exposed to different primary air pressures in, for example, three or four different sectors along the length of the grate track. A partition of primary air supply across the width of the grate track has not been tried previously, or it is realised across multiple grate tracks located next to one another, in that easily or poorly separated combustible waste in them is burnt. A primary air separation however becomes important in the case of an even larger grate width without separation of the tracks because the difference in qualities of waste distributed over the grate width is often unavoidable.

The objective of the present invention is therefore to create a water-cooled sliding combustion grate which, based on state of the art technology, is further developed in such a way that it enables the realisation of significantly wider grate tracks, i.e. grate tracks with widths of 6 meters or more. In the process, a possible tilt of the movable grate plates should be effectively avoided in the case of grate plate lengths of more than 6 meters. Further, the drive should be easier to maintain, in that it is accessible in a special design during the combustion operation and the hydraulic piston-cylinder units of the individual drives of the grate plates can be replaced without the need for interrupting the operation of the grate. The primary air feed of such a combustion grate with extra wide grate track should also be separable over its width in a particular arrangement.

The objective is achieved by a water-cooled sliding combustion grate composed of movable grate plates or of movable grate plates which are alternately combined with stationary grate plates, in which these grate plates lie on top of each other in a step-like manner characterised by a measurement of more than 6 meters for the length of the grate plates passing through the width of the grate track, wherein they are supported upon intermediate steel girders. The movable grate plates are driven by a parallel drive made of two separate drive units. Each end of a movable grate plate can be moved forwards and backwards by means of such a drive unit, in which the two drive units can be synchronised.

First a sliding combustion grate with a conventional hydraulic drive is illustrated in the drawings and then this special water-cooled sliding combustion grate with parallel drive and primary air separation is presented here and its functions are further described below with the help of drawings.

Figure 2:
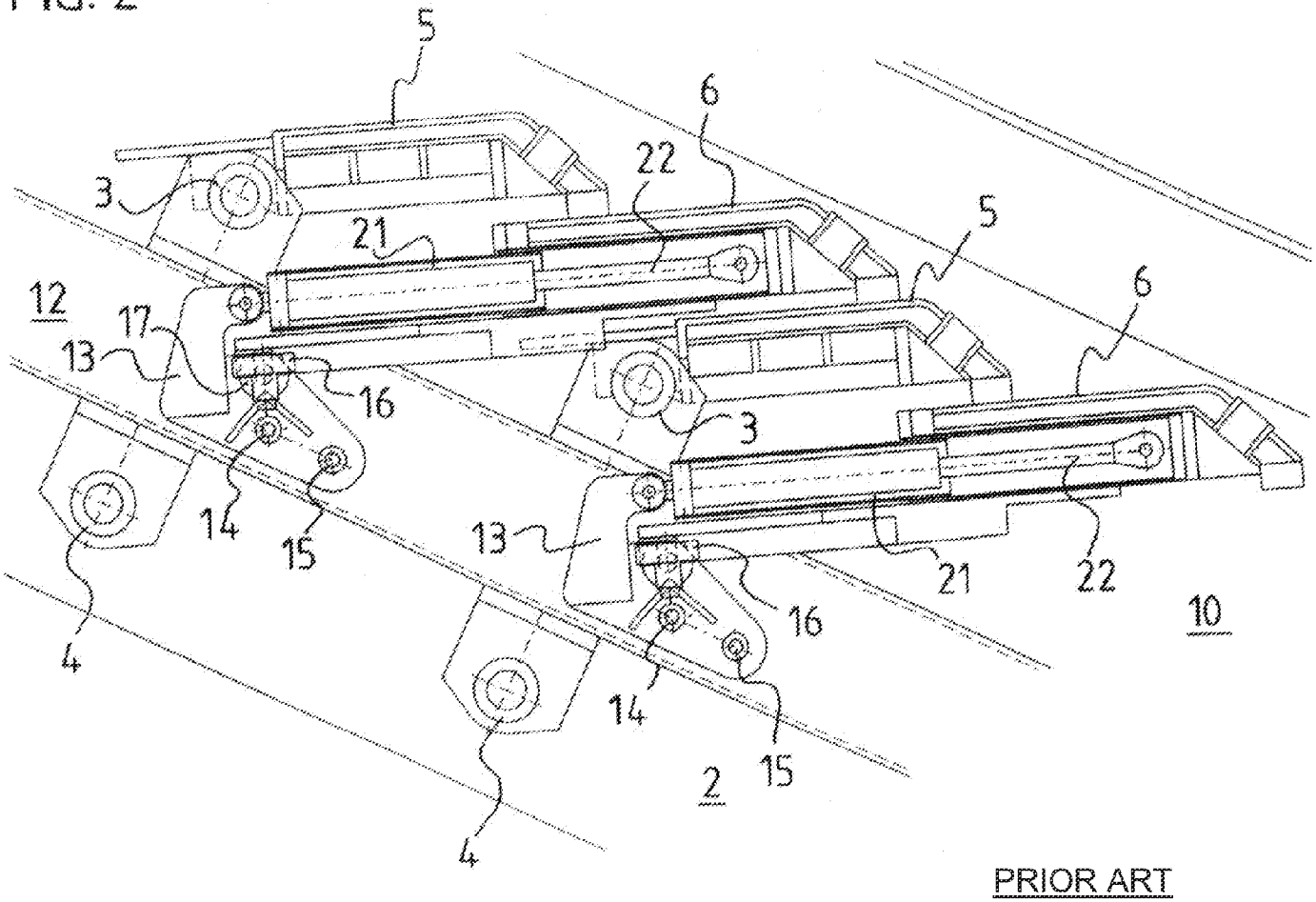
FIG. 2 PRIOR ART
Figure 3:
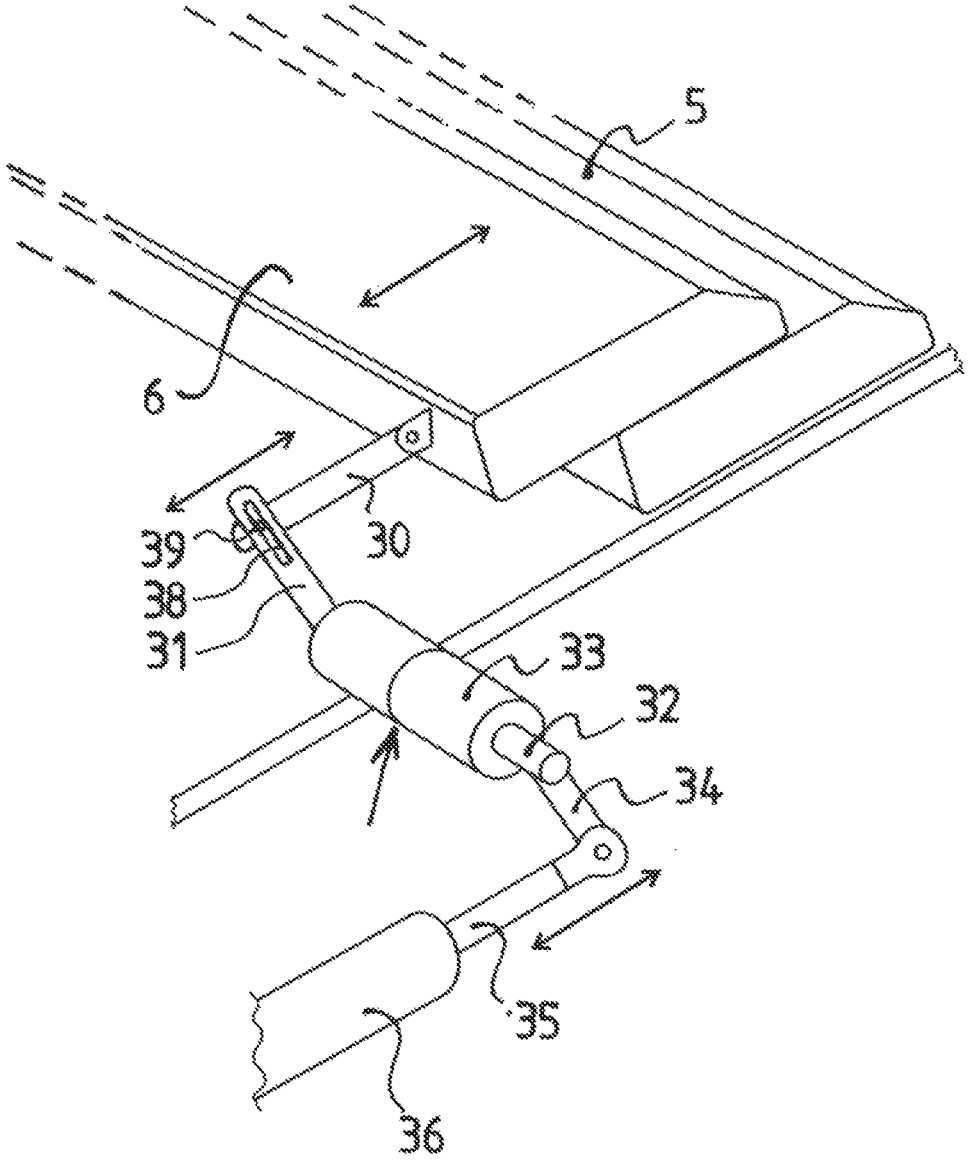
Figure 4:
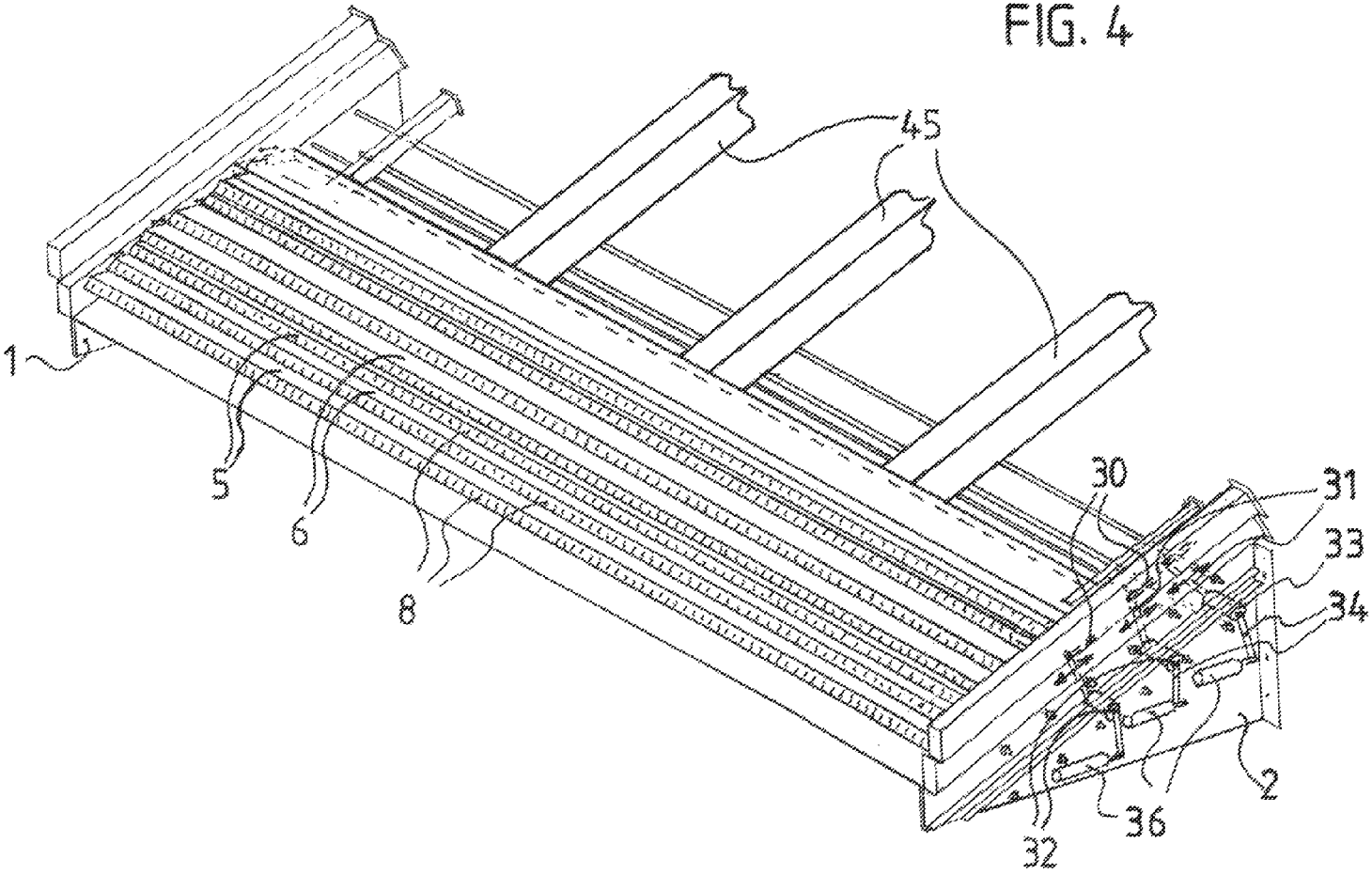
Figure 5:
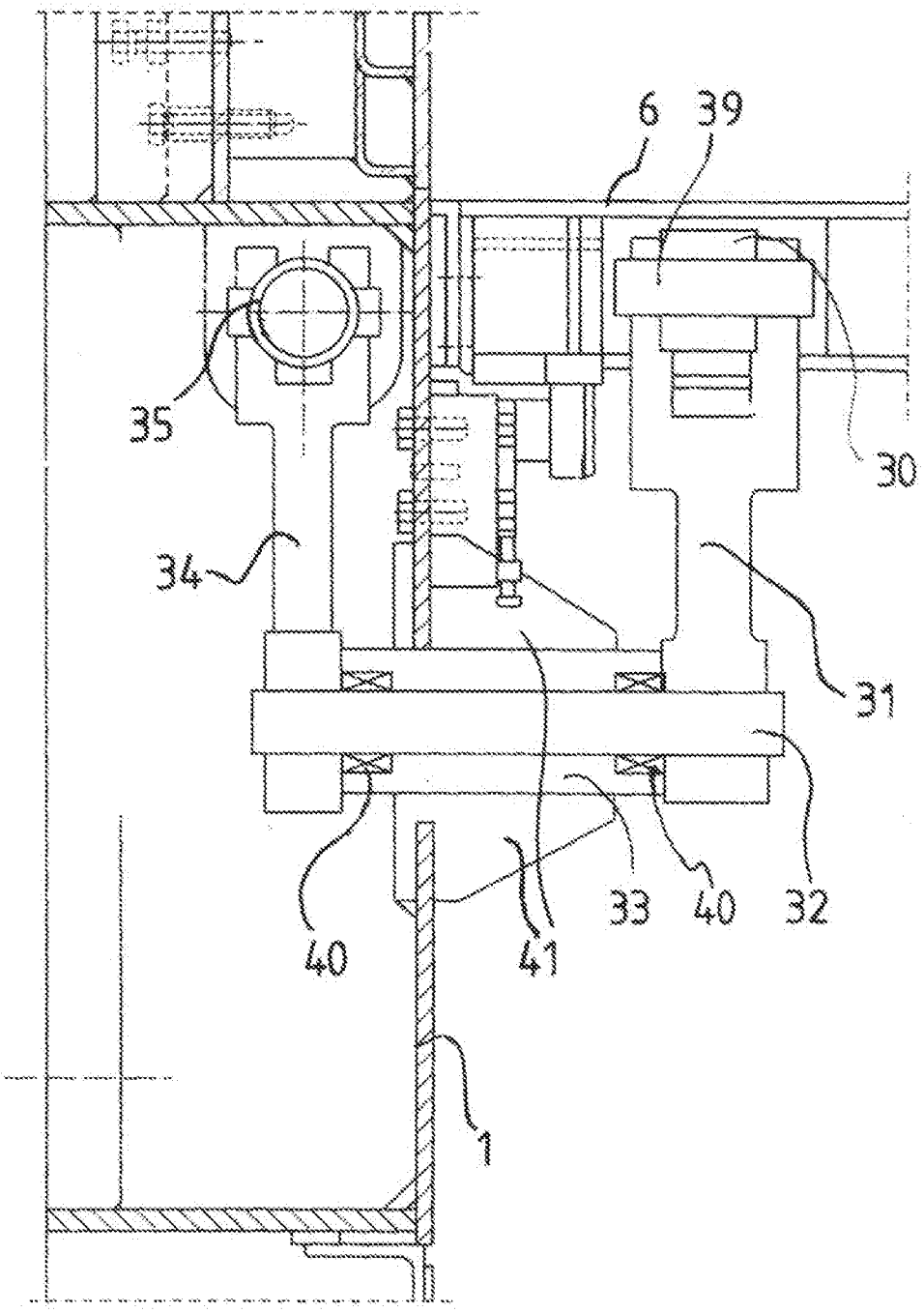
Figure 6:
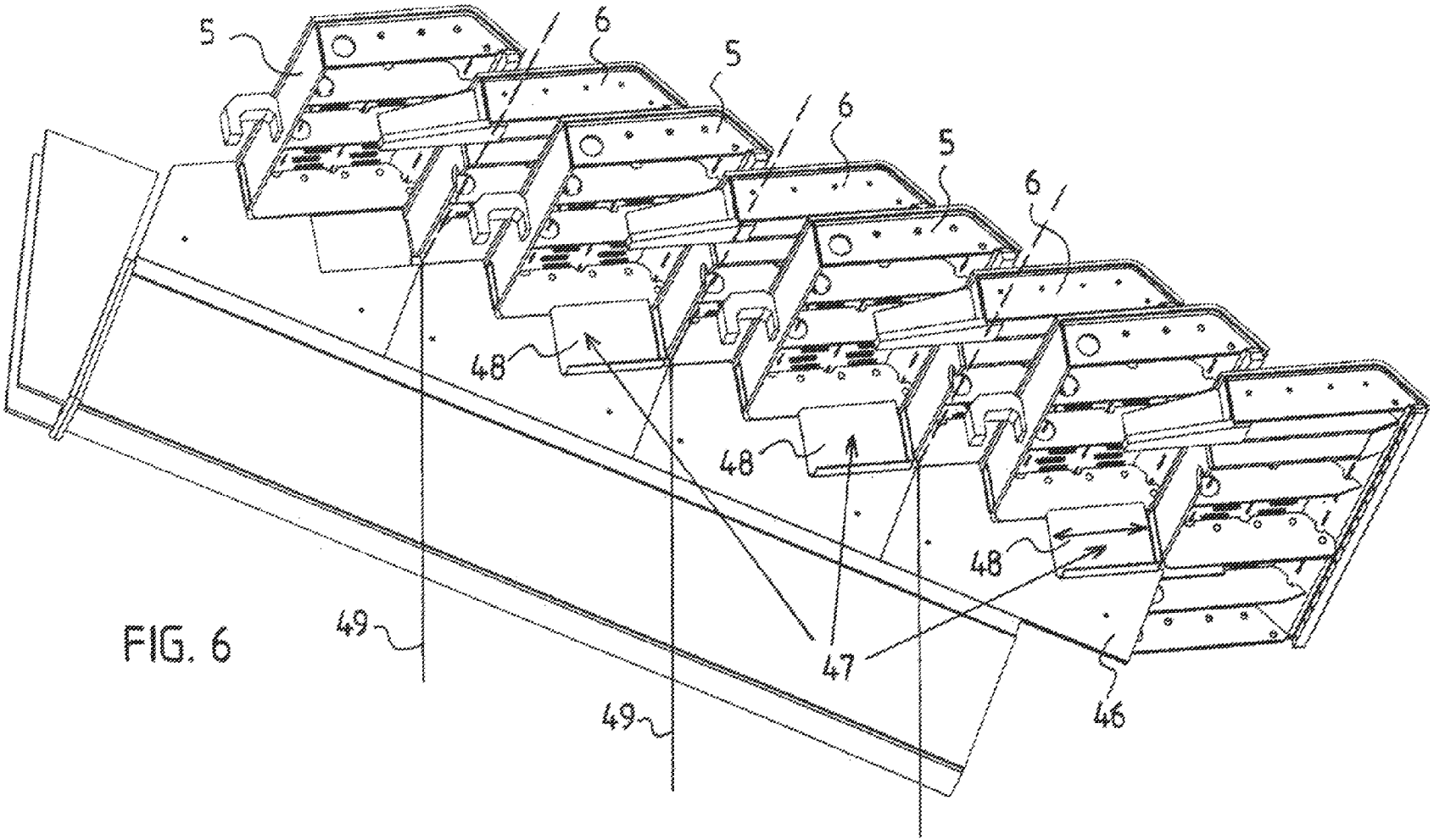

It shows:

FIG. 1: A sliding combustion grate with conventional drive in perspective view with partially removed grate plates;

FIG. 2: A longitudinal section through the grate track, with a view perpendicular to the grate track and the conventional hydraulic drives integrated under it;

FIG. 3: The basic principle of an individual drive unit of the two drive units of the parallel drive of a movable grate plate that are located laterally to the grate;

FIG. 4: A perspective representation of a longitudinal section of the sliding combustion grate with parallel drive of the individual movable grate plates according to the invention;

FIG. 5: A cross-section transverse to an edge of a grate track with a single hydraulic drive unit outside the side wall for the grate plate located to the right of the viewing direction;

FIG. 6: A diagonal view from below the sliding combustion grate with a partition for the primary air supply across the width of the grate track.

Figure 7:
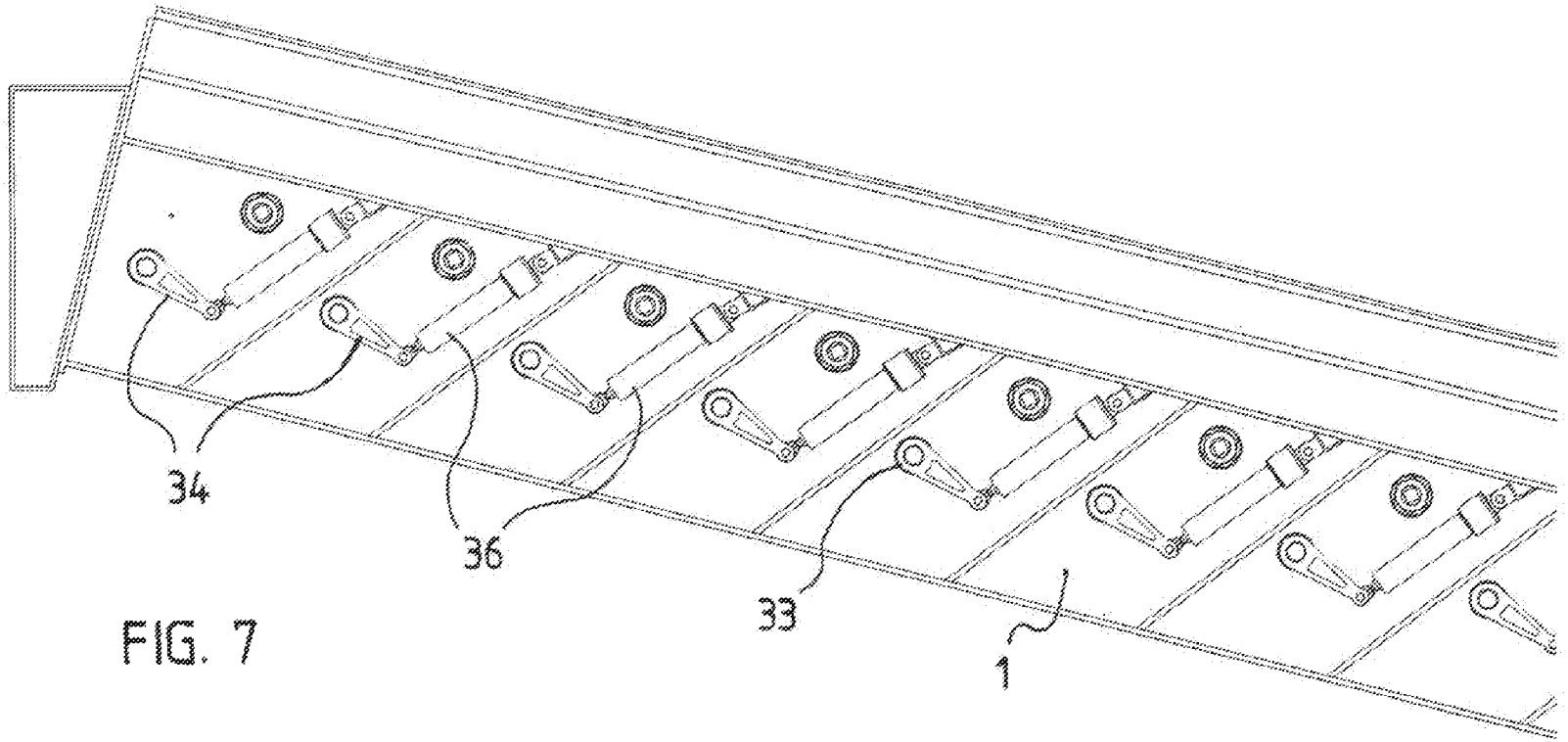
Figure 8:
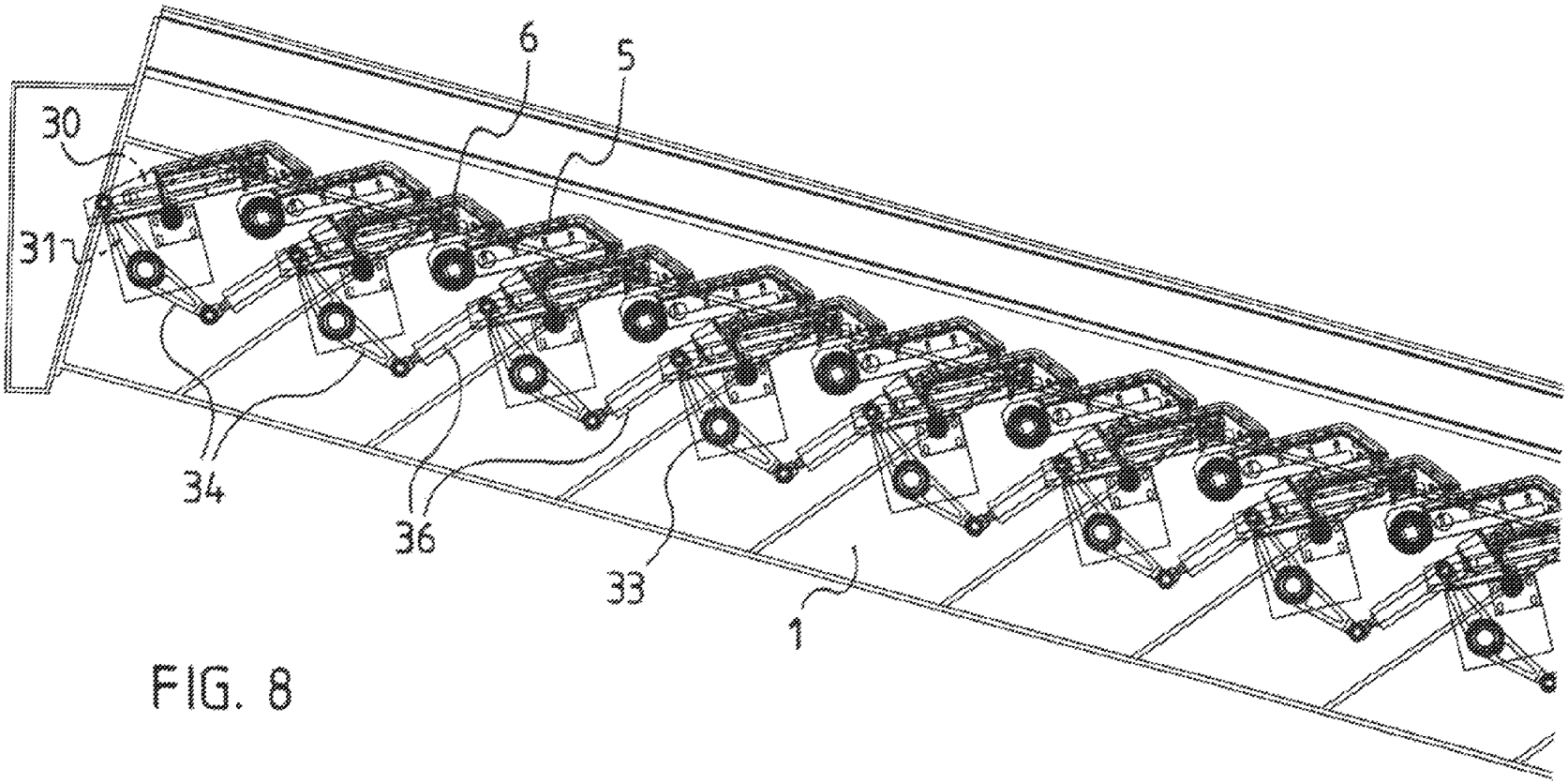
Figure 9:
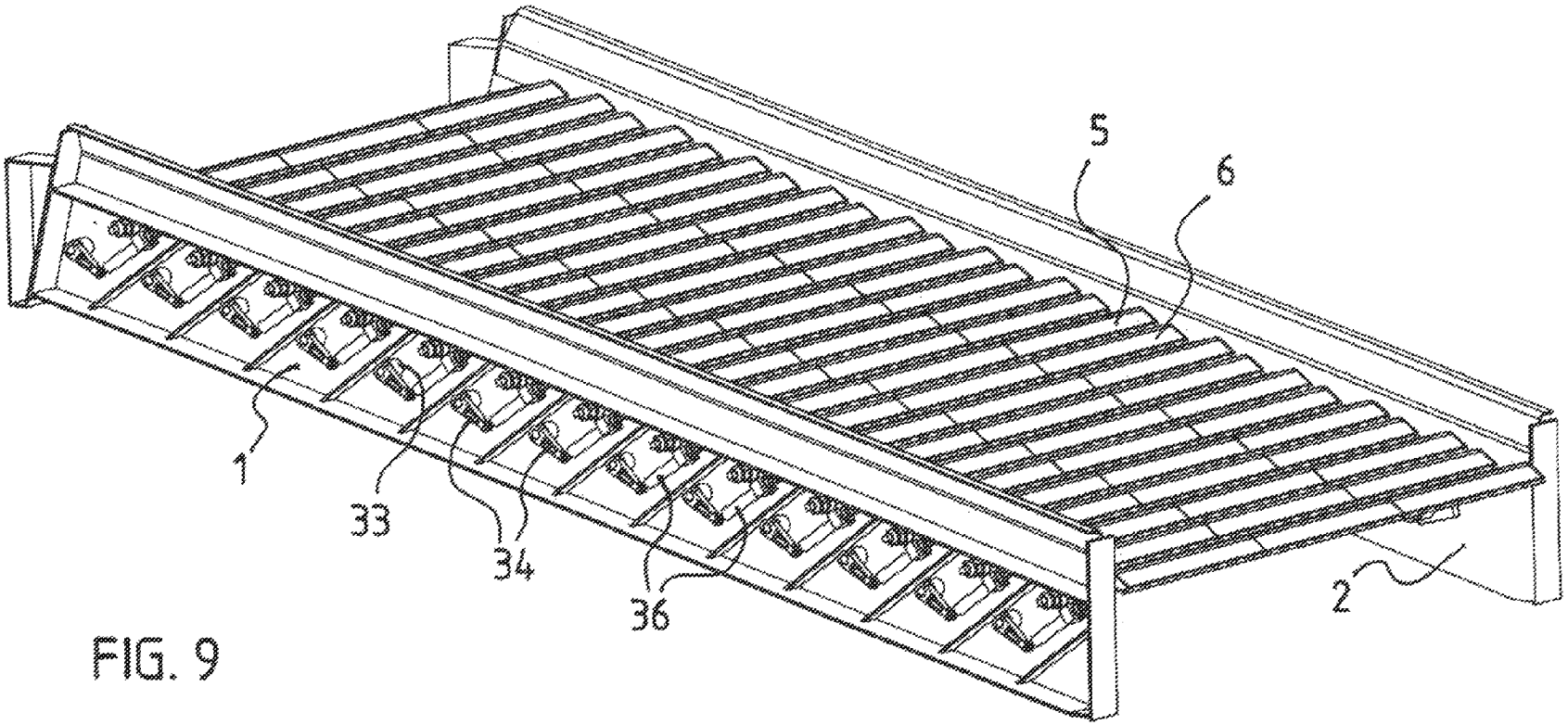
Figure 10:
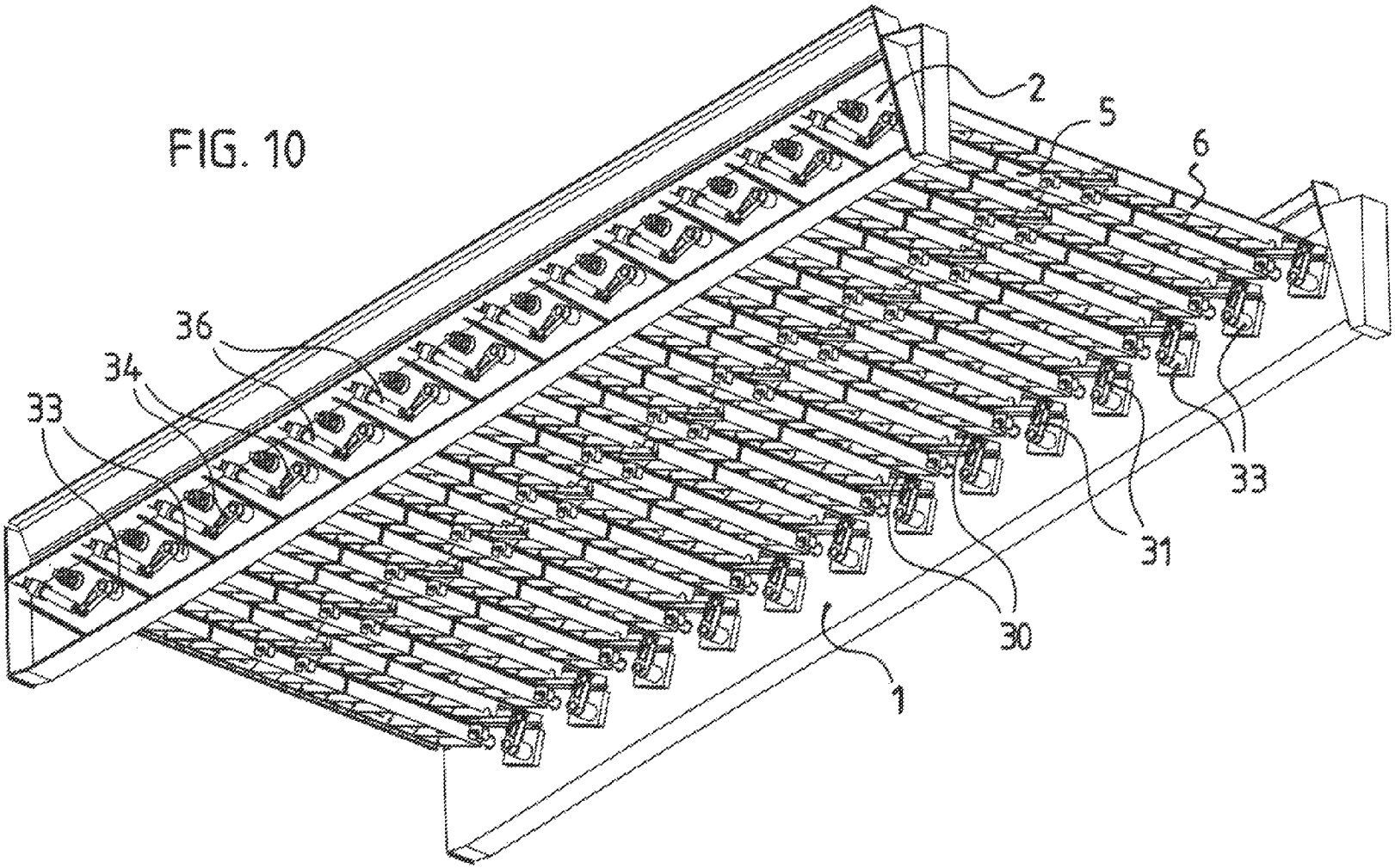

FIG. 7: A lateral view of a single-track grate with parallel drive;

FIG. 8: A lateral view of a single-track grate with parallel drive and with the elements installed behind the side wall;

FIG. 9: A total view of the single-track grate with parallel drive with a view of the upper side of the grate;

FIG. 10: A total view of the single-track grate with parallel drive with a view of the underside of the grate;

The basic construction of a conventional sliding combustion grate with its important elements, how it is presented during the construction, where the individual grate plates are still missing and the view of the substructure are evident from FIG. 1. Here it concerns a grate with a grate track width of approx. 2 m inclined downwards in the direction of flow. Two vertical, lateral steel walls 1,2, parallel to one another, are connected stably to one another with distancing bars 3,4. These distancing bars 3,4 run perpendicular to the grate and extend across the inside width between the two vertical steel walls 1,2 at two different levels. Both the steel walls 1,2 to the left and right of the grate can thereby consist of multiple steel sheets or parts which are screwed to one another in a suitable manner. Distancing bars 3,4, threaded at both ends, penetrate the two vertical steel walls 1, 2 and are screwed tightly to the vertical steel walls 1,2 by means of tapered ends and nuts. The top level of distancing bars or crossbars 3 also serve as support rods for the stationary grate plates 5 lying on top of them. The front edge of the bottom stationary grate plate 5 abuts against a discharge lip 7 welded in place between vertical steel walls 1,2, while its rear section is suspended over the first top distancing bar or crossbar 3. Next in line is a movable grate plate 6, the front bottom edge of which rests on the first stationary grate plate 5 below. The front bottom edge of the next highest stationary grate plate 5 rests in turn on movable grate plate 6 and so on. The sloped front side of the individual grate plates 5,6 is perforated by primary air slots 8, through which the primary air for the combustion is blown from below into the incinerator charge. Along the upper edge of steel walls 1,2 are two square tubes 9,10 disposed on top of each other in a slightly offset manner, the lower ends of which are sealed by welding, in that they are welded there. These square tubes 9,10 constitute the side panels of the grate track and restrict the sides of the incinerator charge bed when the grate is in operation. They are water-cooled and are forcibly flooded with water from bottom to top so that their insides are always completely filled with water. The individual grate plates 5,6 are made from sheet steel and are designed as hollow bodies that are forcibly flooded with water so that their insides are always completely filled with water and no air bubbles can be present inside. Alternatively, the grate plates consist of a support framework in which a free-flowing hollow body is inserted as a cooling body whereby this can then be covered by a wear plate which is interlocked with the support framework and the cooling body to ensure good heat transfer. All the sheet steel parts of the grate, whether square tubes 9,10 or grate plates 5,6, that come into contact with the incinerator charge are, therefore, continuously covered with water on the back side of the steel sheet or at least cooled by a water-cooled heat sink. Hence all the parts in contact with the fire are cooled continuously and kept at a stable temperature so that practically no dilatation occurs. This eliminates the need to provide compensating elements of any kind to the sides of the grate plates. The stability of the grate construction is essentially achieved by the distancing bars or crossbars 3,4, which strut and brace the two outer steel walls 1,2 on two parallel levels as already described. Between these two levels of crossbars 3,4, running along the grate on both sides of its centre are two other hollow profiles in the form of square tubes 11,12, which are connected at the bottom and at the top at some points to the crossbars 3,4, running perpendicular to them. One of the square tubes, namely square tube 11, feeds the cooling water from bottom to top for grate plates 5,6, while the other square tube 12 supplies flushing and cooling air for the hydraulic components of the drive of the movable grate plates 6. Support members 13 are installed for movable grate plates 6 between these two parallel-running square tubes 11,12. These support members 13 are fixed to the square tubes by two bolts that run through the two square tubes 11,12. For this purpose, the square tubes or hollow profiles 11,12 have welded-in crossbars with an inside diameter designed to accommodate the retaining bolts for the support members 13. The support members 13 themselves each have steel roll 16 disposed parallel to the corresponding grate plate plane, as well as a steel roll 17,18 to the left and right acting in the vertical plane. The movable grate plate 6 rolls off the last and the horizontal steel roll 16 serves as a lateral guide at the rear side of the grate plate 6. Till a hydraulic cylinder-piston unit 21 with pistons 22 is installed between the Support member 13 and the movable plate lying before it. At the planks, i.e. at the square tubes 9,10, two horizontal steel rolls 19,20 are constructed for every movable grate plate 6 and these rolls are laterally guided into the plates from outside.

FIG. 2 shows an area of this conventional grate according to FIG. 1 with this conventional drive of the movable grate plate 6 as a longitudinal section seen from the side. The hydraulic cylinder 21, whose piston rods 22 reach the interior framework of the movable grate stage 6, can be recognised and the hydraulic cylinder 21 is hinged to a Support member 13 with its rear side. At the rear, the grate plate 6 rolls off on the rolls 17 of the support member 13 which is fixed to the square tubes 11,12 by means of both bolts 14,15. Each of these support members 13 can be tilted backwards by removing the rear bolt 14 after which the pivot point of the hydraulic cylinder 21 is accessible and this can be readily dismantled. That can however take place only after decommissioning of the grate. The square tube 10 can be recognised behind the grate plates 5,6 which forms the lateral plank and below the side wall 2 with the crossbars 4.

The hydraulic drive is located directly under the grate plates and always at their centre in the case of these present constructions as shown in FIGS. 1 and 2. A parallel drive of the movable grate plates is newly realised in the sliding combustion grate introduced here which enables the realisation of significantly wider grate tracks and eliminates the need for lateral guiding of the grate plates with their own steel rolls. For this purpose, every movable grate plate is driven individually on its two side ends or on its lateral ends, whereby the two individual drives for every movable grate plate can be perfectly synchronised with one another. A single drive unit on one side of a movable grate plate 6 is shown as a schematic diagram in FIG. 3. A connection rod 30 acts on the movable grate plate 6. This connection rod 30 is connected to a crank 31 which sits on a crankshaft 32. The crank 31 has a slotted hole 38 in which the bolts 39 of the connection rod 30 are mounted because the connection rod 30 must move back and forth linearly in the direction of its course as shown with a double arrow when the crank 31 pivots back and forth angularly and consequently its end does not carry out a linear motion. The crankshaft 32 is supported in a bushing 33 which penetrates the side wall of the grate construction and is stably welded or screwed to this, namely at the point indicated with an arrow. On the outside of the grate construction, the crankshaft 32 is equipped with another crank 34 which is hinged to the end of a piston rod 35 of a hydraulic cylinder 36. The cranks 31,34 can be simply plugged in at the crankshaft ends and can be secured with a lock nut. With its other end, the hydraulic cylinder 36 is hinged to a retaining bracket which is fixed to the outside of the side wall of the grate construction. The axle of the bushing 33 runs at a right angle to the direction of motion of the movable grate plate 6 and the crank 31 for the connection rod 30 at the crankshaft 32 can be mounted to the crank 34 at the other end of the crankshaft 32 by swivelling by approx. 120° to 180°. When the crank 34 is actuated at this other end of the crankshaft 32 and the crankshaft 32 is turned correspondingly, the visible end of the movable grate plate 6 is accordingly moved forward and backwards as with the forward and backward movements of the piston 35 by means of the hydraulic cylinder-piston unit 35, 36. The crankshaft 32 can be turned by 0° to approx 60° by means of systematic controlling of the hydraulic piston-cylinder unit 35,36 so that the degree of thrust of the movable plate 6 can be continuously varied. An identical drive for the movable grate plate 6 is located at the other side of the grate track so that a parallel drive is formed. Proportional valves in combination with a position measuring system for the hydraulic piston-cylinder units enables accurate synchronisation of extension and retraction so that the movable grate plates 6 driven by them always move exactly parallel to the stationary grate plates 5. The hydraulic components are installed completely outside the grate construction with this drive design. Thereby, only the heavy mechanical parts of the overall drive design, which themselves cannot have any other parts, are exposed to the abrasive effect of the downdraught. The drive parts that are sensitive to the downdraught are outside the grate and are always accessible there even during the operation of the grate.

The hydraulic components are situated further away from the grate with this drive construction and are no more directly beneath the grate. Every single movable grate stage can be operated in this way via its two own hydraulic cylinder-piston units which are fixed to the two side walls on the outside of the grate construction and can be operated individually compared with all other movable grate plates, All other movable grate plates are operated in a similar way by pairs of hydraulic drives.

A perspective representation of the sliding combustion grate with parallel drive of the individual movable grate plates 6 according to the invention is shown in FIG. 4. The hydraulic cylinder-piston units 36 with a piston and the associated crank 34 and crankshaft 32 with a bushing 33 to its bearing can be perceived at the side wall 2 visible here and the local crank 31 and connection rod 30 for operation of a movable grate plate 6 on one side of it is visible on the other side. Both the ends of the movable grate plates 6 are provided with such hydraulic drives so that every movable grate plate 6 has an individual parallel drive. This drive type enables realisation of wider grate tracks than those known previously. Two to four and more conventional grate tracks can be replaced with one individual, single track grate. No dilatation problem develops because the water-cooled grate plates can be maintained within a narrow temperature band due to its cooling. The bending stress of the grate plates in the direction of motion is exceptionally high due to the flat design of the grate plates 6 and does not present any impediments for the operation of grate plates more than 6 meters in length. The grate plates can be made of multiple segments, which are tightly screwed to one another, across the width of the grate track. The steel framework is preferably installed as segments which hold a hollow body that can be placed in and guided through them and are then screwed on to a wear plate in thermal contact with the hollow body. Owing to this parallel drive, grate tracks with continuous grate plates of 10 m, 12 m or longer and thus corresponding grate tracks of the same width can be constructed. Only the load on the grate plates 6 as a consequence of the incinerator charge lying on it must be absorbed through further support structures. The grate plates 5,6 are designed in a board shape, longer than wider or taller and cannot act as a self supporting bridge over a length of 12 meters and more or a track width of 12 meters or more in spite of its internal structure. To absorb this load, the substructure of the grate has one or more steel girders 45 which are installed in the longitudinal direction of the grate track and act as rails. The grate stages are also adequately stiff in the drive direction, which means no additional auxiliary constructions such as grate carriages, transverse shafts or similar are required. Only the weight of the grate and that of the refuse lying on top of it is carried by the longitudinal beams 45. Such a grate track width can hardly be realised with the conventional grate bars made of cast iron due to the small width of the grate bars. Also an auxiliary construction would be required with such elements. Three steel girders 45 are installed in the example shown so that the grate plates 5,6 can be supported for all the 3 meters in the case of a grate track width of 12 meters. The stationary grate plates 5 rest directly on these steel girders 45 while the movable grate plates 6 are provided with steel rolls on their underside and these steel rolls then roll on the upper side of these steel girders 45, whereby the load due to the incinerator charge and the own weight of the water-cooled grate plates 5,6 are borne by these steel girders 45.

The layout of the hydraulic cylinder-piston units outside the grate tracks are as illustrated and described above, that means outside at the side walls 1,2 of the grate construction, has an advantage that these components are accessible at all times and are also exposed to little risk of fire than when located underneath the grate. However the parallel drive introduced here can also be implemented in such a way that the hydraulic drives are designed in the same way instead of in the middle of every grate plate as previously arranged. However they are replaced by two such drives which are located at both the ends of the grate plates. The parallel drive is also implemented in this way and both the hydraulic cylinder-piston units can be extended and retracted with accurate synchronisation by means of proportional valves in combination with a position measuring system, so that the movable grate plate 6 driven by the units always moves exactly parallel to the stationary grate plates 5.

A cross-section through the grate track with a view of the rear in the direction of motion of the movable grate plate 6 is shown in FIG. 5. A connection rod 30 is hinged to a recess at the bottom of the grate plate 6. The connection rod 30 is flexibly connected to the crank 31 which is at the bottom of the crankshaft 32 via the bolts 39. The crankshaft 32 is supported in the bushing 33 by means of the replaceable slide bearing 40. The bushing is stably connected to the side wall 1 of the grate construction via the vane struts 41. These vane struts 41 are integrated with the corresponding recesses in the side wall 1 or 2 of the grate construction and are welded to them. The drive is present on the other side, of which the crank 34 and the piston rod 35 are illustrated in a section here. In this example, these two elements are arranged above the crankshaft 32 contrary to the variants in FIGS. 3 and 4. The assembly of the hydraulic cylinder-piston units can however be freely chosen depending on the space conditions.

FIG. 6 shows a section of a grate track seen diagonally from below with a partition over the length of the grate track for the primary air supply. The problem due to the increasing width of a grate track is that the incinerator charge on the grate is not homogeneous when seen over the width of the grate. When a single, uniform primary air pressure is used over the complete width of the grate, the easily combustible incinerator charge receives more air because it obstructs the primary air supply vents for a shorter period while the poorly combustible incinerator charge heavily covers the primary air supply vents in the grate plates and suppresses an efficient air supply. The opposite of what is required occurs, namely that the easily combustible incinerator charge is especially supplied adequately with primary air while the poorly combustible incinerator charge is correspondingly supplied with lesser primary air. Also the poorly combustible incinerator charge hardly burns while the easily combustible incinerator charge has already burnt down. A uniform burn-up can be achieved when the primary air supply does not take place with uniform pressure over the complete width of such a wide grate track. A separation of the primary air zones across the width of the grate is however a prerequisite for this. It is realised as shown in FIG. 6. A vertical partition 46 extends here along the grate track under the grate, its stationary grate plates 5 and its movable grate plates 6. The partition 46 is guided with its upper edge to the underside of the grate plates 5,6 so that it completely attaches itself to the underside and a lasting seal between the two sides of the partition 46 is created. The partition 46 has a recess 47 behind the movable grate plates 6. A separator plate 48 is added to the rear side of the movable grate plates 6 which covers this recess from one side and overlaps the partition 46. Thereby, the recess in the partition 46 is also dosed and when the movable grate plates 6 are moved, the separator plate 48 at the partition 46 is moved forwards and backwards sealed tightly across the recess 47. The partitions 46 are sealed underneath to the floor of the grate construction and the chambers thus formed are also sealed at the front and back. They form a separate primary air compartment which extends beneath the grate track across its overall length. But this compartment can be additionally subdivided into different longitudinal compartments across the length of the grate track, in which the corresponding partitions 49 are installed. Thereby, an entire matrix of primary air compartments is created, in which every individual compartment can be equipped with a separate primary air supply. Correspondingly the combustion can be controlled individually according to air requirement at each position above a primary air compartment with its own primary air pressure.

The piston-cylinder units of the parallel drives can also be arranged in other mounting directions as shown in FIG. 4, depending on the space conditions. The individual hydraulic cylinders are preferably arranged in a staircase manner over one another and mounted on the outside of the side wall. In the case of vertically arranged cylinders, the cranks at the crankshaft must be rotated by 90°. In the case of cylinders tilted at an angle of 45°, they should correspondingly be rotated by 45° opposite to the execution shown in the figures. To gain some space, multiple alignments can also be chosen interchangeably.

The lateral view of a single-track grate with parallel drive is shown in FIG. 7 in which the drive elements are installed differently than previously illustrated. The hydraulic cylinder-piston units 36 are installed at an oblique angle outside the side wall 1 and the pistons act on the cranks 34 diagonally from below. The cranks then turn the crankshaft in the bushing 33. As seen in FIG. 8, the crankshaft then swivels the crank 31 located under the grate and over the connection rod 30 of the movable grate plate 6. These elements are located behind the side wall 1 of the grate construction and are nevertheless marked in FIG. 8, namely the stationary grate plates 5 and the movable grate plates 6.

The single-track grate with parallel drive is shown completely in FIG. 9 with a view of the grate surface, diagonally from above. One can recognise the drive elements from the hydraulic cylinder-piston unit 36, the crank 34 and the bushing 33 installed laterally on the side wall 1. These drive elements support the crankshaft. Finally, the same grate as seen diagonally from below is illustrated in FIG. 10, seen from the other side of the grate. Therefore the underside of the grate can be seen. Movable grate plates 6 alternate with stationary grate plates 5 and the drive elements on the internal side wall 1 visible here are installed on the same, namely the bushing 33 which penetrates the side wall, the cranks 31 and the connection rods 30 actuated by them for moving the movable grate plates 6, so that they can carry out sliding and feeding strokes. Every single movable grate plate 6 can be moved individually. It is clear that such a parallel drive at all the grate plates of a grate can be realised so that it is only composed of movable grate plates.

The invention claimed is:

1. A water-cooled sliding combustion grate comprising:

multiple movable grate plates (6) and stationary grate plates (5), wherein the grate plates (5,6) lie on top of each other in a step-like manner, and the grate plates (5,6) extend continuously across the width of a grate track and have a length of more than 6 meters;

two individual drive units for every movable grate plate (6) connected to lateral ends of the movable grate plate (6) forming a parallel drive for each movable grate plate (6), each movable grate plate (6) being driven individually on lateral ends thereof by the two drive units, wherein the two drive units are synchronized with each other; and one or more steel girders (45) disposed underneath the grate plates (5,6) in the longitudinal direction of the grate track wherein the grate plates (5,6) are supported upon the one or more steel girders (45), and the load of incinerator charge and the weight of the grate plates (5,6) are borne by the one or more steel girders (45), and the movable grate plates (6) equipped with steel rolls on the underside thereof roll on an upper side of the one or more steel girders (45).

2. The water-cooled sliding combustion grate according to claim 1, wherein the two drive units of the parallel drive of each movable grate plate (6) can be synchronised by means of proportional valves in combination with a position measuring system for the hydraulic piston-cylinder units that are installed.

3. The water-cooled sliding combustion grate according to claim 1, wherein each of the two drive units of the parallel drive of each movable grate plate (6) comprises a hydraulic cylinder-piston unit (35,36) that is installed at outer side walls (1,2) of the grate outside the grate track, and the hydraulic cylinder-piston unit acts on a crankshaft (32) via a piston (35) and a crank (34), the crankshaft penetrates the side wall (1,2) and another crank (31) with connection rod (30) is located under the grate at other end of the crankshaft, whereby the connection rod (30) has an impact on the movable grate plate (6).

4. The water-cooled sliding combustion grate according to claim 1, wherein each of the two drive units for the parallel drive of every movable grate plate (6) comprises a hydraulic cylinder-piston unit installed underneath the grate adjacent to the internal side wall (1,2), wherein pistons of the drive units have an effect on outer ends of the movable grate plate (6).

5. The water-cooled sliding combustion grate according to claim 1, wherein at least one partition (46) extends along the grate track under the grate, the stationary grate plates (5) and the movable grate plates (6) for separation of primary air across multiple sections transversely across the grate track, the partition (46) is guided with an upper edge thereof to the underside of the grate plates (5,6) so that the partition (46) is completely attached to the underside of the grate plates (5,6), the partition (46) has a recess (47) behind the movable grate plate (6) so that the movable grate plate (6) can be moved in the recess (47), whereby a separator plate (48) is installed on the backside of the movable grate plate (6) which covers the recess (47) from one side and overlaps the partition (46).

6. The water-cooled sliding combustion grate according to claim 5, wherein multiple primary air compartments are further realised in the longitudinal direction of the grate track, in that further partitions (49) are installed vertical to the partitions (46) in the longitudinal direction of the grate track so that a matrix of primary air compartments is realised.

7. The water-cooled sliding combustion grate according to claim 5, wherein every individual primary air compartment can be provided with a separate primary air supply at varying pressures.

8. The water-cooled sliding combustion grate according to claim 6, wherein every individual primary air compartment can be provided with a separate primary air supply at varying pressures.

9. A water-cooled sliding combustion grate composed exclusively of movable grate plates (6) or of movable grate plates (6) which are combined with stationary grate plates (5), in which these grate plates (5,6) lie on top of each other in a step-like manner characterised by a measurement of more than 6 meters for the length of the grate plates (5,6) extending continuously across the width of a grate track, wherein the grate plates (5,6) are supported upon one or more steel girders (45), the movable grate plates (6) are driven by a parallel drive made of two separate drive units, each end of a movable grate plate (6) can be moved forwards and backwards by means of such a drive unit, in which the two drive units can be synchronized;

wherein at least one partition (46) extends along the grate track under the grate, the stationary grate plates (5) and the movable grate plates (6) for separation of primary air across multiple sections transversely across the grate track, the partition (46) is guided with an upper edge thereof to the underside of the grate plates (5,6) so that the partition (46) is completely attached to the underside of the grate plates (5,6), the partition (46) has a recess (47) behind the movable grate plate (6) so that the movable grate plate (6) can be moved in the recess (47), whereby a separator plate (48) is installed on the backside of the movable grate plate (6), and the separator plate (48) covers the recess (47) from one side and overlaps the partition (46).

10. The water-cooled sliding combustion grate according to claim 9, characterised in that both the drive units of each movable grate plate (6) can be synchronised by means of proportional valves in combination with a position measuring system for the hydraulic piston-cylinder units that are installed.

11. The water-cooled sliding combustion grate according to claim 9, characterised in that each of the drive units of the parallel drive of each movable grate plate (6) comprises a hydraulic cylinder-piston unit (35,36) which is installed at the outer side walls (1,2) of the grate outside the grate track and which acts on a crankshaft (32) via a piston (35) and a crank (34), the crankshaft penetrates the side wall (1,2) and another crank (31) with connection rod (30) is located under the grate at other end of the crankshaft, whereby this connection rod (30) has an impact on the movable grate plate (6).

12. The water-cooled sliding combustion grate according to claim 9, characterised in that each of the drive units for the parallel drive of every movable grate plate (6) is composed of a hydraulic cylinder-piston unit which is installed underneath the grate adjacent to the internal side wall (1,2), in which pistons of the drive units have an effect on the outer ends of the movable grate plate (6).

13. The water-cooled sliding combustion grate according to claim 9, characterised in that the one or more steel girders (45) are installed in the longitudinal direction of the grate track for absorption of the load on the combustion grate, and act as rails on which the stationary grate plates (5) are supported and on which the movable grate plates (6) are mounted with rolling support, in that the movable grate plates (6) are equipped with steel rolls on their underside.

14. The water-cooled sliding combustion grate according to claim 9, characterised in that multiple primary air compartments are further realised in the longitudinal direction of the grate track, in that further partitions (49) are installed vertical to the partitions (46) in the longitudinal direction of the grate track so that a matrix of primary air compartments is realised.

15. The water-cooled sliding combustion grate according to claim 14, characterised in that every individual primary air compartment can be provided with a separate primary air supply at varying pressures.

16. The water-cooled sliding combustion grate according to claim 9, characterised in that every individual primary air compartment can be provided with a separate primary air supply at varying pressures.

* * * * *